United States Patent [19]

Reilly et al.

[11] Patent Number: 4,655,272

[45] Date of Patent: Apr. 7, 1987

[54] AUTOMATIC DRAPERY PLEATING DEVICE AND METHOD

[76] Inventors: Letizia Reilly, 4 Ridge Rd., Walpole, Mass. 02081; Rita Acerra, 112 Orchard St., Millis, Mass. 02054

[21] Appl. No.: 634,698

[22] Filed: Jul. 26, 1984

[51] Int. Cl.[4] ..... A47H 13/14; A47H 5/00

[52] U.S. Cl. ..... 160/348; 160/344

[58] Field of Search ..... 160/348, 349, 344

[56] References Cited

U.S. PATENT DOCUMENTS

| | | | |
|---|---|---|---|
| 2,159,733 | 5/1939 | French | 160/344 |
| 2,474,552 | 6/1949 | Steinmeyer | 160/349 X |
| 3,001,578 | 9/1961 | Ratlift | 160/349 X |
| 3,011,174 | 12/1961 | Schaerer | 160/348 |
| 3,019,486 | 2/1962 | Stinson | 160/231 A |
| 3,948,307 | 4/1976 | Schöfer | 160/348 |
| 4,226,276 | 10/1980 | Bressler | 160/348 |

FOREIGN PATENT DOCUMENTS

| | | | |
|---|---|---|---|
| 1264701 | 3/1968 | Fed. Rep. of Germany | 160/349 |

*Primary Examiner*—Ramon S. Britts
*Assistant Examiner*—Cherney S. Lieberman
*Attorney, Agent, or Firm*—Donald W. Meeker

[57] ABSTRACT

An elongated strip of stiff material formed with a series of transverse folds across the strip. At least two adjacent panels between folds turn inwardly to form pleats between spaced control panels. Each control panel has at least two parallel string encasement means aligned with encasement means on other control panels. A control string through the control panels and extending beyond the strip draws all of the control panels into close proximity with adjacent control panels all in the same plane. Between adjacent control panels pleat panels are folded inwardly to form pleats which are then tacked to the control panels. All of the pleats are formed simultaneously and automatically. The top of the drapery material is folded over the strip and tacked together to form a sleeve over the strip. Each panel may be tacked to the drapery material. The strip may be extruded of synthetic material and the folds formed by stamping living hinges at desired intervals in the strip.

19 Claims, 9 Drawing Figures

AUTOMATIC DRAPERY PLEATING DEVICE AND METHOD

BACKGROUND OF THE INVENTION

Technical Field

The invention relates to the fabrication of draperies and in particular to a device and method for automatically fabricating pleats in draperies and a method for fabricating the device in quantity.

Background Art

Forming pleats in draperies is a tedious job done primarily by hand to shape each pleat by measuring, folding and tacking one at a time.

Devices exist for fast tacking, but a person must still measure and fold each pleat individually.

Standard measuring devices are of some assistance in setting a uniform system for measuring the pleats, but again each must be handled individually.

Although there are methods for making pinch pleated draperies, no good method existed for making accordian pleats in draperies until the present.

No previous method for making pleats in draperies applied equally well to mass production as well as custom work.

No prior art method or device produced both simultaneous and automatic pleat formation in a drapery.

DISCLOSURE OF INVENTION

The primary object of the present invention is to provide a method and device for forming pleats in draperies, wherein all of the pleats are formed simultaneously and automatically in the drapery by the simple operation of pulling on the ends of the strings at each end of the device to create all of the folds forming the pleats.

Preformed folds in the device of the invention create any desired pattern of pleats in the drape when the strings are pulled to fold all of the creases in the device thereby folding the surrouding drapery material into the desired folded pleats. Any standard or custom pleat style may be formed by the device, including accordian pleats comprised of a series of closely spaced V-shaped pleats.

By a plastic extrusion recess, the drapery pleating devices may be mass produced with "living hinges" at the folding joints for low cost production.

By creating standard folds in the device the invention may be used effectively in mass producing draperies using standard pleat patterns. By producing unique custom folds the invention may be used in custom designing draperies. In both cass the device provides simultaneous and automatic formation of the pleats when the drapery material is sewn around the device at the top of the drapery with a tack made for each fold, and the strings protruding from each end are pulled to fold the device and thus the drapery into the desired pleat pattern.

A relatively simple easy to fabricate device provides an easy, efficient and very effective method for creating pleats in draperies.

BRIEF DESCRIPTION OF THE DRAWINGS

These and other details and advantages of our invention will be described in connection with the accompanying drawings, which are furnished only by way of illustration and not in limitation of the invention, and in which drawings.

BEST MODE FOR CARRYING OUT THE INVENTION

Figure 1:
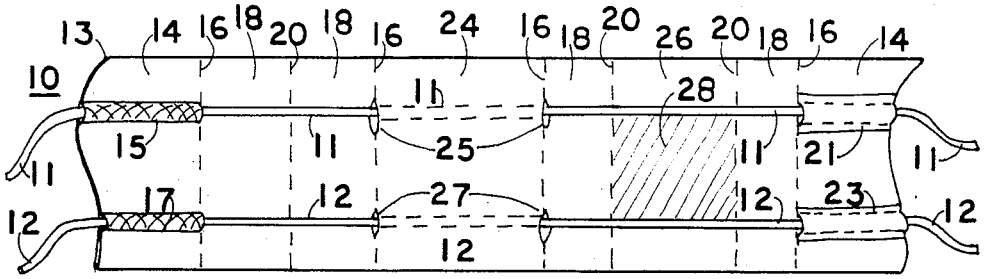
FIG. 1 is a front elevation view of the flat automatic drapery pleating device showing the creases in dashed lines where the device is to be folded to form the pleats.

In FIG. 1 the automatic drapery pleating device 10 is shown laid out as a flat elongated strip 13 of relatively stiff material which would correspond in length to the horizontal length of the drapery to be pleated. Transverse folds 16 and 20 across the width of the strip create a series of panels 14, 18, 24 and outwardly bending 26 along the strip, which panels are folded inwardly bending in various desired patterns to form pleats.

Figure 2:
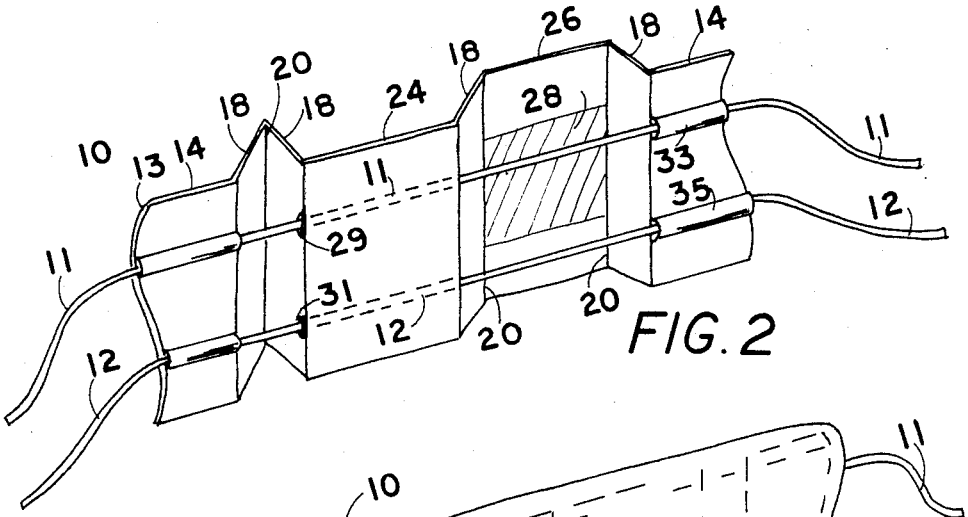
FIG. 2 is a perspective view of the invention shown partially folded to indicate how the pleats are formed by the method.
Figure 3:
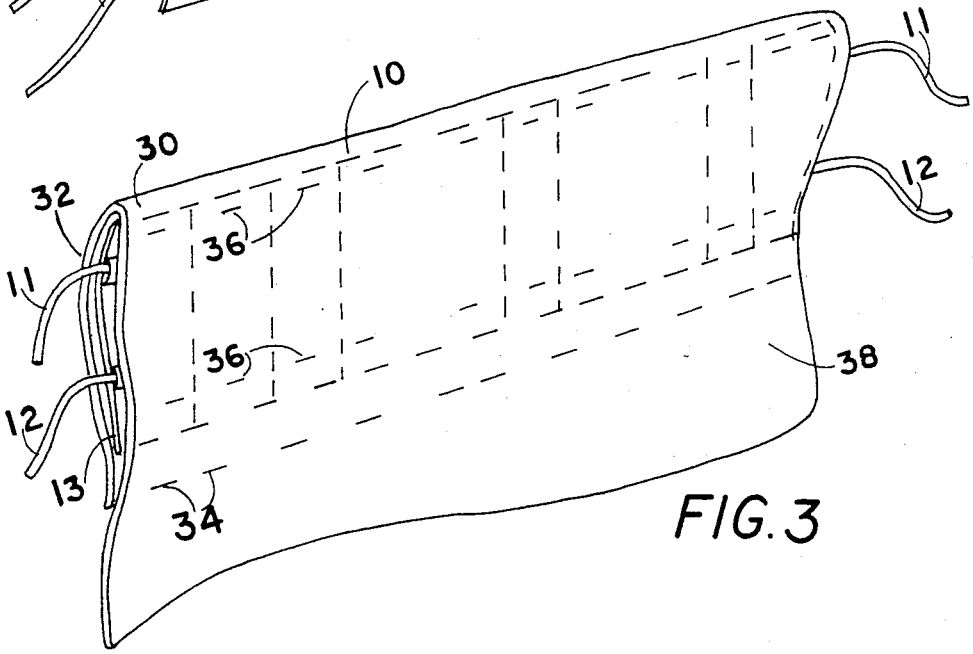
FIG. 3 is a perspective view showing how the drapery material is secured around the invention.

In FIGS. 1, 2 and 3 interior control panels 24 and end control panels 14 are each provided with a pair of spaced parallel string encasement means 15 and 17 secured to each control panel in parallel alignment with the strip, and further in alignment with corresponding string encasement means on the other control panels. Located toward the top and bottom edges of the strip 14, the string enclosure means may be formed by weaving a tube-like enclosure 15 and 17 or stitching strips of material 21 and 23 to form a tunnel-like enclosure on the control panel as in FIG. 1, tacking little loops 40 and 42 of thread in alignment to each control panel as in FIG. 4, or cutting aligned slits 25 and 27 in the material on the folds as in FIG. 1. These methods are primarily intended for fabric strips. In plastic strips and fabric strips other methods of making the string enclosure means include: cutting slits 41 and 43 at the folds and elevating linear half-tubular sections 44 and 48 of the control panels as in FIG. 6, securing plastic tubing sections 45 and 47 in alignment along the control panels by adhesive or heating as in FIG. 6, securing half-sections of plastic tubing 33 and 35 in linear alignment on the control panels by adhesive or heating as in FIG. 2, or by cutting openings 29 and 31 in the folded panels 18 adjacent to the control panel as in FIG. 2 to slip the control string behind the control panel (shown dashed). Control strings 11 and 12 are inserted through the string encasement means on each control panel and extend at each end past the end of the strip.

Figure 8:
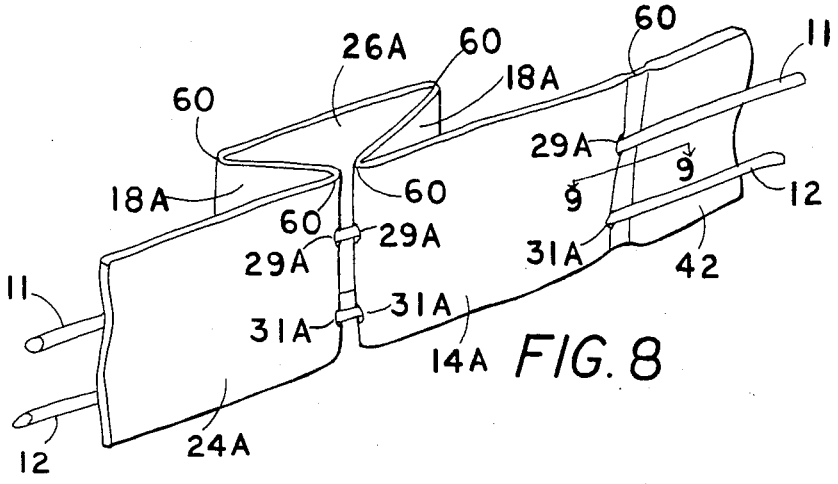
FIG. 8 is a perspective view of the invention showing how the device is creased and folded via the "living hinges" portion of the device.
Figure 9:
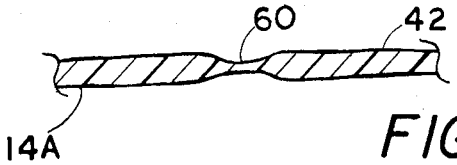
FIG. 9 is an enlarged cross sectional view of the invention taken through 9—9 on FIG. 8 using A with numbers to denote plastic by design.

Between each adjacent pair of control panels the proximate edge of each control panel comprises an inwardly bending fold 16 between the control panel 14 and 24 and adjacent folding pleat panels 18. The fold is formed by providing less material along the fold line than in the panels. In material strips less fabric is provided forming a thread hinge in cloth material or a paper hinge in stiff paper or cardboard material. In plastic strips formed by extruding or molding, the fold may be a "living hinge" formed by creating a crease along the fold line with less plastic (nylon or other synthetic as illustrated in FIGS. 8 and 9 where the pleating mechanism is shown illustrating the "living hinges" in both a flattened position and the folded position which would result from the use of the mechanism. "Living Hinge" 60 is an area along the horizontal length of the mechanism which is thinner in width than other areas along the length of the mechanism. It is by means of the "living hinge" that pleat panels 26 and 18 are formed. FIG. 9 is a cross sectional view of the "living hinge" illustrating the comparatively thin area of the hinge in the "living hinge" in contrast to the standard width along the length of the device. Aligned, openings 29A and 31A are either formed in "living hinges" during the molding process or cut through by a stamping process. The control strings will align as in FIG. 2 at openings 29 and 31. Woven paper or paper board could be used).

Between folded pleat panels 18, outwardly bending folds 20 are formed in a direction opposite to those adjacent to the control panels enabling the folding pleat panels to be folded together and the control panels 14 and 24 to be drawn closer together while remaining aligned in one plane. Additional pleat panels 26 may be positioned between the inwardly folding panels 18 to form a multiple panel pleat. In a three panel pleat, such as the pinch pleat in FIGS. 2, 4 and 5, the third pleat panel 26 remains in parallel alignment with the control panels but positioned behind the control panels. Any of the panels may be further stiffened by adding additional material in the form of a rectangular stiffening means 28 in FIGS. 1 and 2, which is generally the same material as that of the strip and may be secured by adhesive or heating for making the panels stronger to resist bending.

Figure 4:
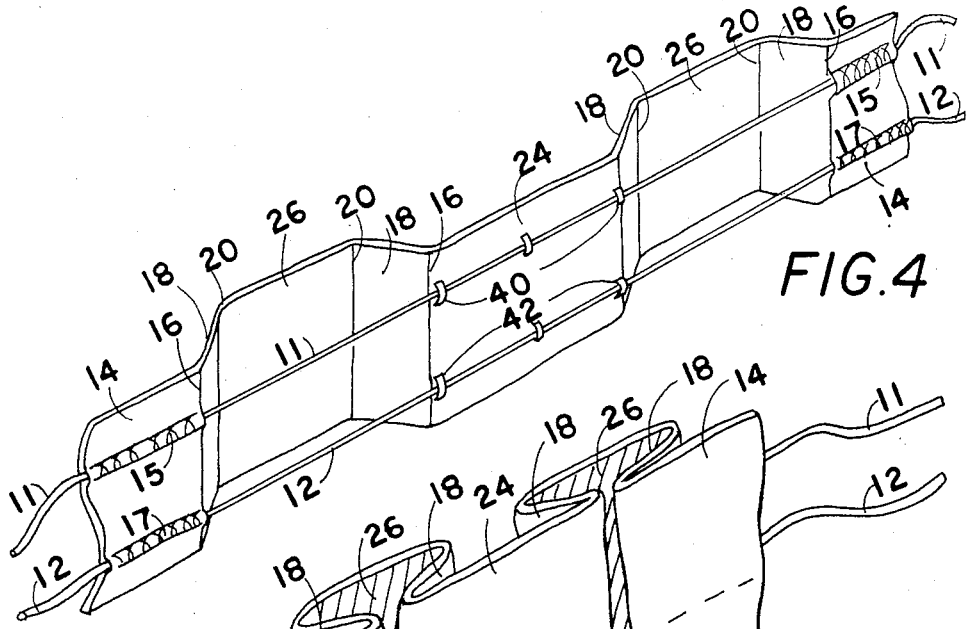
FIG. 4 is a perspective view of the invention showing how the device is creased and folded for pinch pleats.
Figure 5:
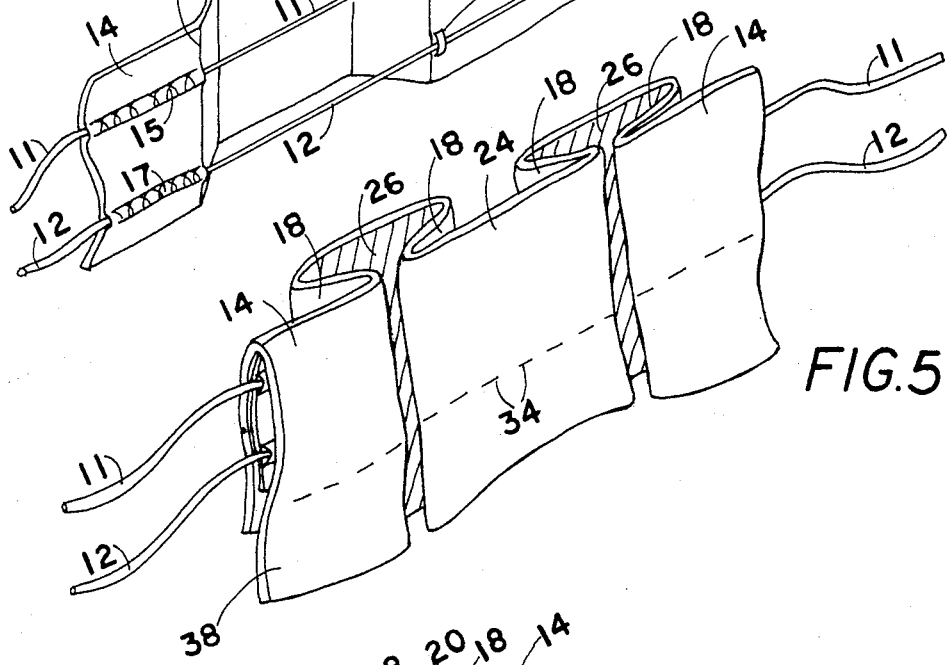
FIG. 5 is a perspective view of the drapery material on the device formed into pinch pleats.
Figure 6:
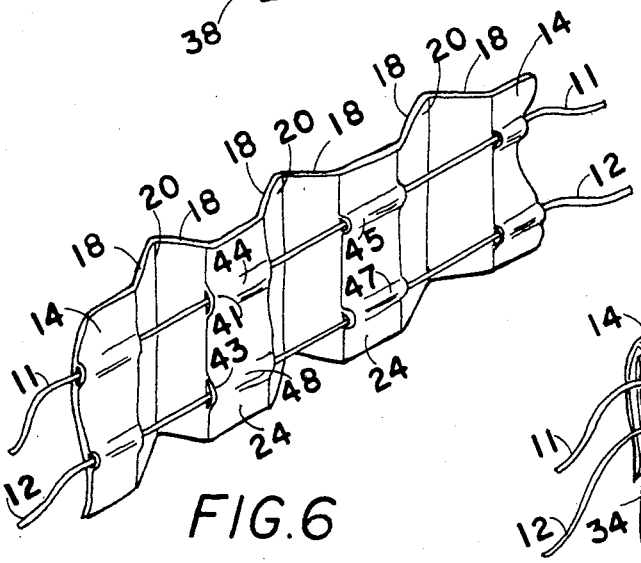
FIG. 6 is a perspective view of the invention showing how the device is creased and folded for accordian pleats.
Figure 7:
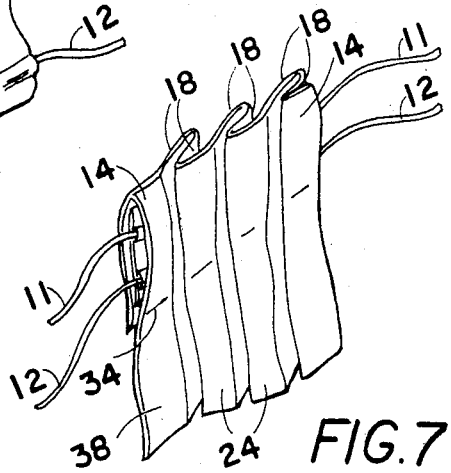
FIG. 7 is a perspective view of the drapery material on the device folded into accordian pleats.

Various patterns of pleats may be formed including standard pleats of popular patterns for mass production and custom designed pleats of unusual patterns. In FIGS. 4 and 5 a pinch pleat pattern is shown with three panels forming the pleat having two inwardly folding pleat panels 18 and one pleat panel 26 parallel to the control panels between each adjacent pair of control panels. When the control strings 11 and 12 are pulled each adjacent pair of control panels is drawn together in close proximity. An unusual accordian pleat pattern in FIGS. 6 and 7 is formed by having two pleat panels 18 between each adjacent pair of control panels so that when the control strings 11 and 12 are pulled the folding pleat panels form an acute angle and bend over all in the same direction to contact the back surface of the control panels with each adjacent pair of control panels drawn together in close proximity. The accordian pleat control panels 14 and 24 are generally smaller than those of the pinch pleat pattern.

One efficient means of mass producing the automatic drapery pleating strips is to extrude long thin strips of synthetic moldable material, such as nylon or plastic, to form the strip with folds stamped to form living hinges and any openings stamped into the material. String encasement means may be heat welded or adhered to the strips. Strips of cloth fabric which are, thin at the folds or cardboard with only paper at the folds are other possible fabrication means.

In use the method of making automatic and simultaneous pleats in a drapery of any length involves securing the top of the drapery material 30 with a flap 32 of the material over the strip 13 and the flap tacked to the rest of the drapery material by a normal series of threaded tacks 34 in FIG. 3. For greater effectiveness each panel of the strip may then be secured to the drapery material by a single threaded tack 36. The horizontal length of the drape should correspond to the length of the strip 13 with the end of the control strings 11 and 12 extending beyond the ends of the drapery material. The ends of the control strings 11 and 12 are then pulled evenly to draw all of the control panels together in one long plain causing the folding pleat panels to fold behind the control panels forming the desired pleats in the drape all simultaneously and automatically, as in FIGS. 5 and 7. All that remains is to tack each pleat in place by conventional means for finished pleated draperies.

It is understood that the preceding description is given merely by way of illustration and not in limitation of the invention and that various modifications may be made thereto without departing from the spirit of the invention as claimed.

We claim:

1. An automatic pleat forming strip for creating pleats in drapery, wherein the automatic pleat forming strip comprises:

an elongated strip of stiff material approximately corresponding in length to the horizontal length of a drapery to be pleated, wherein the strip along its length is folded on transverse compressed areas spaced apart and sequenced in a pattern of inward and outward folds to form alternating inwardly folding pleats of two or more panels and outwardly facing single control panels between each pleat;

parallel to the strip on each control panel at least two linear string encasement means for maintaining linear alignment between control panels;

a control string longer than the strip inserted through each aligned series of linear string encasement means on the control panels, so that each end of each string extends beyond each of the two ends of the strip so that pulling each of the two ends of each string draws the control panels together in linear alignment with the pleats folded inwardly;

wherein the drapery material is folded over along a top edge to encompass the strip with the string ends extending beyond two side edges of the drapery; and wherein the elongated strip is fabricated from a continuous strip of rigid material formed into inherently stiff panels separated by narrow, compressed areas forming inherently flexible transverse folds.

2. The invention of claim 1 wherein a rectangular stiffening means is secured to each panel.

3. The invention of claim 1 wherein the linear string encasement means comprises woven tubes of thread secured to each control panel.

4. The invention of claim 1 wherein the linear string encasement comprises fabric tacked onto each panel to form a tubelike structure.

5. The invention of claim 1 wherein the linear string encasement means comprises a series of aligned thread loops attached to each panel.

6. The invention of claim 1 wherein the linear string encasement means comprises sections of rigid tubing secured to each panel.

7. The invention of claim 1 wherein the linear string encasement means comprises a series of slits formed in alignment in the folds of each control panel and the control string is inserted in the slits.

8. The invention of claim 1 wherein the linear string encasement means comprises a series of openings formed in the inwardly folded panels in alignment adjacent to each control panel and the control string is inserted through the openings.

9. The invention of claim 1 wherein the linear string encasement means comprises a series of slits formed in alignment in the folds of each control panel and a linear segment of each control panel elevated between slits on each control panel to form an encasement for the control string.

10. The invention of claim 1 wherein the linear string encasement means comprises elongated bent strips of plastic secured in alignment on each control panel with the string inserted between the strips of plastic and the control panels.

11. The invention of claim 1 wherein the strip is formed from extruded synthetic material and the folds are formed by compressing the material at the folds to form living hinges.

12. The invention of claim 1 wherein the strip is formed from cardboard material and the folds are formed by compressed areas of cardboard or paper with no reinforcing material at the folds while providing each panel with reinforcing material.

13. The invention of claim 1 wherein the strip is formed from fabric material and the folds are formed by leaving thin fabric along the folds and thicker fabric in each panel.

14. A method of fabricating automatic pleat forming strips for creating pleats in draperies, wherein the method comprises:

fabricating from rigid material an elongated continuous strip of relatively thin but stiff material corresponding in length to a horizontal length of a drapery to be pleated;

compressing spaced areas of the srip transversely at intervals along the strip to form thin linear compressed areas creating inherently flexible folds leaving thicker material between each fold to form inherently rigid panels between folds, which strip is folded in a pattern of inward and outward folds to form alternating inwardly folding pleats of two or more panels and outwardly facing single control panels between each pleat;

providing in control panels at least two paralled linear string encasement means housing a control string for maintaining linear alignment between control panels;

inserting a control string longer than the strip through each aligned series of linear string encasement means on the control panels, so that each end of each string extends beyond each of the two ends of the strip so that pulling each of the two ends of each string draws the control panels together in linear alignment with the pleats folded inwardly.

15. The invention of claim 1 wherein the pleats are pinch pleats formed by an inwardly folding panel adjacent to each control panel and, connecting the two inwardly facing panels, a panel parallel to the control panel.

16. The invention of claim 1 wherein the pleats are accordian pleats formed by an inwardly folding panel adjacent to each control panel, wherein the two inwardly folding panels are connected by a fold to form an apex.

17. A method for automatically making pleats in drapery, wherein the method comprises:

forming a strip of folded panels in an elongated strip of rigid material by creating a series of control panels which remain in alignment while, between each adjacent pair of control panels, at least two pleat panels fold inwardly, wherein folds are formed compressing a narrow area between panels, and wherein an inwardly directed transverse fold in the strip at each end of each control panel forms the pleat panels which are interconnected by at least one transverse fold in a direction opposite to the control panel folds and wherein the elongated strip is fabricted from a continuous strip of rigid material formed into inherently stiff panels separated by narow compressed areas forming inherently flexible transverse folds;

forming on each control panel, paralled to the strip, at least two linear string encasement means for maintaining linear alignment between control panels, wherein each means for encasing string is positioned as part of a series so that all of the encasement means in a series align along the entire lenth of the strip;

inserting a control string through each aligned series of string encasement means on all of the control panels so that each of the two ends of the string extend beyond each of the two ends of the strip;

folding a top edge of the drapery over the string along the entire length of the strip to encompass the strip, wherein the horizontal drapery length corresponds approximately to the length of the strip, so the string ends extend beyond the drapery ends;

pulling each of the two ends of the string to form the desired pleats in the drapery between the control panels;

tacking the pleats in place.

18. The method of claim 17 wherein the pleats are pinch pleats formed by creating a third pleat panel by folding the strip transversely on each pleat panel adjacent to a control panel in a direction opposite to that of the folds between the control panels and the adjacent pleat panels;

wherein pulling the string ends folds each pleat panel adjacent to a control panel inwardly, thereby maintaining the third pleat panel parallel to the control panels.

19. The method of claim 17 wherein the pleats are accordian pleats formed by creating a transverse fold between the two pleat panels adjacent to each of the two adjacent control panels in a direction opposite to the fold formed between each control panel and the adjacent pleat panel;

wherein pulling the string ends folds the two connected pleat panels inwardly to form an apex.

* * * * *